US007922627B2

(12) United States Patent
Clark et al.

(10) Patent No.: US 7,922,627 B2
(45) Date of Patent: Apr. 12, 2011

(54) ROTATING EXERCISE DEVICE

(75) Inventors: Richard Alan Clark, Alpharetta, GA (US); Glenn David Ross, Marietta, GA (US)

(73) Assignee: Playpower, Inc., Huntersville, NC (US)

( * ) Notice: Subject to any disclaimer, the term of this patent is extended or adjusted under 35 U.S.C. 154(b) by 0 days.

(21) Appl. No.: 12/574,017

(22) Filed: Oct. 6, 2009

(65) Prior Publication Data

US 2010/0093496 A1 Apr. 15, 2010

Related U.S. Application Data

(60) Provisional application No. 61/104,903, filed on Oct. 13, 2008.

(51) Int. Cl.
*A63B 69/16* (2006.01)
*A63B 71/00* (2006.01)

(52) U.S. Cl. ..... 482/57; 482/51

(58) Field of Classification Search ..... 482/51–52, 482/57–65, 110

See application file for complete search history.

(56) References Cited

U.S. PATENT DOCUMENTS 3,467,373 A * 9/1969 Justice ..... 472/22
3,713,438 A * 1/1973 Knutsen ..... 601/35
3,964,742 A * 6/1976 Carnielli ..... 482/7
4,452,445 A * 6/1984 Csekes ..... 482/63
4,643,419 A * 2/1987 Hyde ..... 482/63
4,711,447 A * 12/1987 Mansfield ..... 463/37
4,881,732 A * 11/1989 Kepiro ..... 482/62
4,928,673 A * 5/1990 Heneger ..... 601/36
5,044,627 A * 9/1991 Huang ..... 482/62
5,314,392 A * 5/1994 Hawkins et al. ..... 482/57
6,669,604 B1 * 12/2003 Lee ..... 482/57
7,115,072 B1 * 10/2006 Stoll ..... 482/51
7,278,956 B1 * 10/2007 Chen ..... 482/57
7,427,255 B2 * 9/2008 Fan ..... 482/57
2007/0281834 A1 * 12/2007 Lai ..... 482/57

* cited by examiner

*Primary Examiner* — Steve R Crow
(74) *Attorney, Agent, or Firm* — Polster, Lieder, Woodruff & Lucchesi, L.C.

(57) ABSTRACT

A rotating exercise device is provided. In various embodiments, the rotating exercise device includes a stationary pedestal and a gearbox rotatably mounted to the pedestal such that the gearbox is rotatable about a longitudinal axis of the pedestal. The rotating exercise device additionally includes a user seat mounted to a top of the gearbox and a user operable drive mechanism that is operably connected to the gear box. The user operable drive mechanism is structured and operable to, via control and operation of a user sitting on the seat, impart rotational force on the stationary pedestal to cause the gear box, seat and user to rotate about the longitudinal axis of the pedestal as the user operates the user operable drive mechanism.

19 Claims, 7 Drawing Sheets

ROTATING EXERCISE DEVICE

CROSS-REFERENCE TO RELATED APPLICATIONS

This application claims the benefit of U.S. Provisional Application No. 61/104,903, filed on Oct. 13, 2008, the disclosure of which is incorporated herein by reference in its entirety.

FIELD

The present teachings relate to exercise equipment, and more particularly, to playground equipment that is designed for enjoyment, but also structured and operable to provide particular types of exercise.

BACKGROUND

The statements in this section merely provide background information related to the present disclosure and may not constitute prior art.

Children generally enjoy playing on the various different known playground equipment and devices, e.g., swings, slides, climbing equipment, etc. However, such equipment and devices are designed for amusement and fail to provide exercise focused on particular muscle groups, movements, physical coordination and/or cardiovascular health.

SUMMARY

The present disclosure provides a rotating exercise device. In various embodiments, the rotating exercise device includes a stationary pedestal and a gearbox rotatably mounted to the pedestal such that the gearbox is rotatable about a longitudinal axis of the pedestal. The rotating exercise device additionally includes a user seat mounted to a top of the gearbox and a user operable drive mechanism that is operably connected to the gear box. The user operable drive mechanism is structured and operable, via control and operation of a user sitting on the seat, to impart rotational force on the stationary pedestal to cause the gear box, seat and user to rotate about the longitudinal axis of the pedestal as the user operates the user operable drive mechanism.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
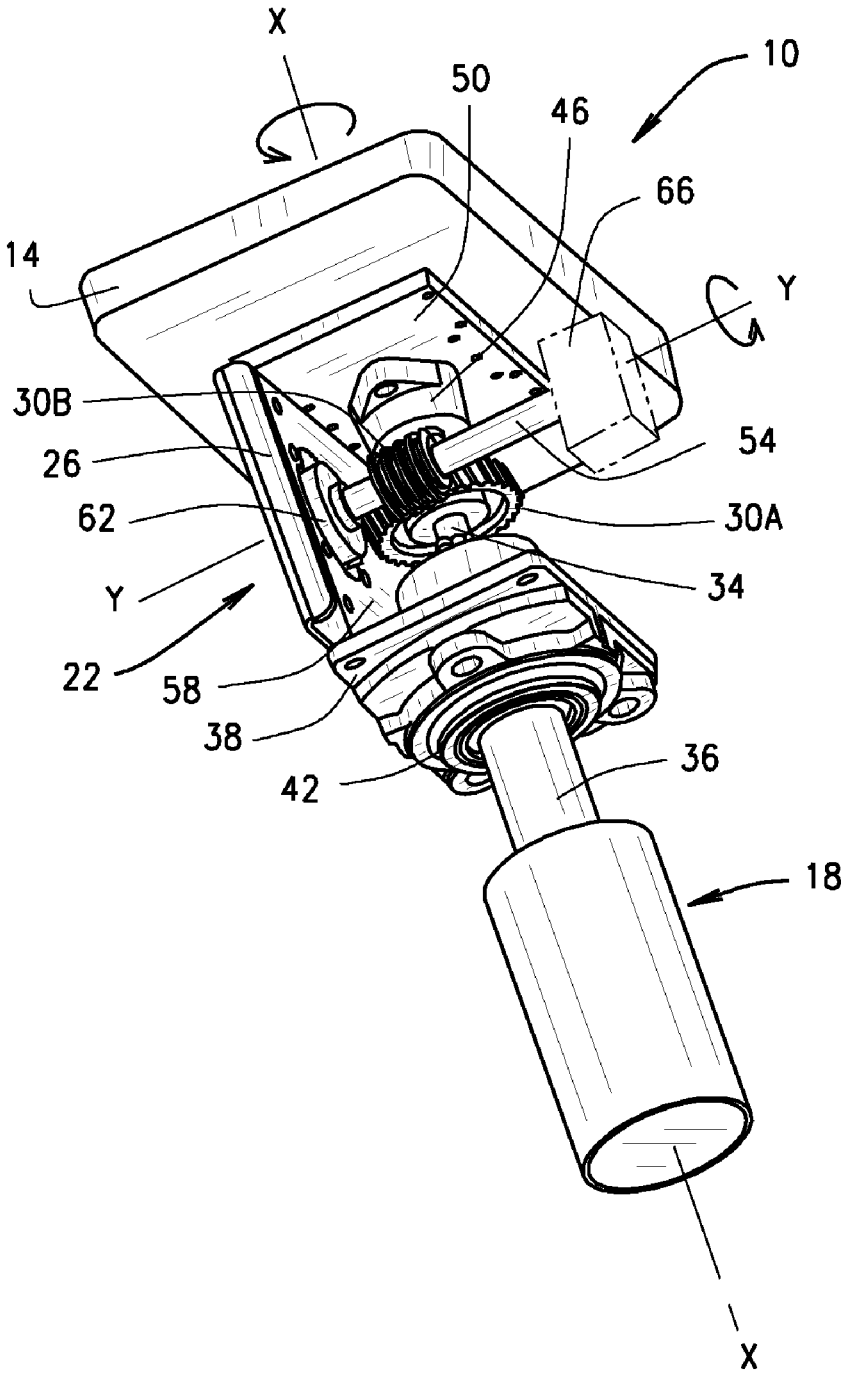
FIG. 1 is an isometric view of a rotating exercise device, in accordance with various embodiments of the present invention.

The following description is merely exemplary in nature and is in no way intended to limit the present teachings, application, or uses. Throughout this specification, like reference numerals will be used to refer to like elements.

Referring to FIG. 1, the present disclosure provides a rotating exercise device 10 that is structured and operable to make exercise more enjoyable and play-like by rotating about a vertical axis as a user performs one or more particular physical activities to operate one or more assemblies of the rotating exercise device 10.

Generally, the rotating exercise device 10 includes a seat 14 rotatably mounted to a pedestal 18 via a gear box 22 such that as a user, sitting on the seat 14, performs one or more particular physical activities, the seat controllably rotates about a substantially vertical longitudinal axis X of the pedestal 18. More particularly, the seat 14 is fixedly mounted to the gear box 22, which in turn is rotatably mounted to pedestal 18. The gear box 22, shown in FIG. 1 having a portion of a housing 26 removed, includes a plurality of interoperable gears 30. At least one of the gears 30 is controllably rotatable by the one or more particular physical activities performed by the user to thereby impart rotation of the other gear(s) 30 and cause rotation of the seat 14 about the X axis.

For example, in various embodiments, the gear box 22 includes worm gear 30A fixedly mounted to a stationary, i.e., non-rotatable, pedestal shaft 34 extending from a neck 36 of the pedestal 18. The pedestal neck 36 is rotatably mounted to a base 38 of the gear box 22 via a bottom bearing fixture 42, such that the gear box 22 and seat 14 are rotatably supported on the pedestal 18. Additionally, the pedestal shaft 34 terminates within a top bearing fixture 46 fixedly mounted to a top plate 50 of the gear box 22 to provide axial stability to the gear box 22 and seat 14 as the gear box 22 and seat 14 rotate about the X axis.

In such embodiments, the gear box 22 further includes a worm drive gear 30B fixedly mounted to a rotatable drive shaft 54 and cooperatively engaged with the worm gear 30A. The drive shaft 54 extends through, and is rotatably mounted within opposing gear box sides 58 via respective opposing side bearing assemblies 62. For ease and clarity of understanding, various gear box sides, including one of the opposing sides 58 and the corresponding side bearing assembly 62, have been removed from FIG. 1. However, one skilled in the art would readily and easily understand the structure and operation of the gear box 22 based on FIG. 1 and the disclosure provided herein. As described further below, the drive shaft 54 is driven, i.e., rotated about an axis Y, via a user operable drive mechanism (UODM) 66. The UODM 66 is illustrated with dashed lines to indicate that the UODM 66 can be any user operable mechanism suitable to rotate, i.e., drive, the drive shaft 54 and worm drive gear 30B fixedly mounted thereto.

Via control and operation of the user, the UODM 66 imparts rotational force on the drive shaft 54 to turn, or rotate, the worm drive gear 30B about the Y axis. Rotation of the worm drive gear 30B, in turn, imparts rotational force on the worm gear 30A. However, as described above, the worm gear 30A is fixedly mounted to the stationary pedestal shaft 34 that is fixedly mounted to the pedestal neck 36. Furthermore, the pedestal 18 is fixedly mounted to any suitable stationary base (not shown) such as the floor of a building, the surface of a play ground, a stationary base platform, etc. Thus, the pedestal 18, the respective pedestal neck and shaft 36 and 34, and the worm gear 30A are substantially stationary. That is, they do not rotate. Therefore, rotational force imparted on the worm gear 30A by the worm drive gear 30B causes the gear box base 38, top plate 50, sides 58 and housing 26 to rotate about the X axis as a result of the user operating the UODM 66. Moreover, as described above, the seat 14 is fixedly mounted to the gear box top plate 50 such that the seat 14 rotates about the X axis along with the gear box base 38, top plate 50, sides 58 and housing 26.

More particularly, in various implementations, the user operates the UODM 66 while sitting on the seat 14. Thus, as the user operates the UODM 66 the user rotates about the X axis making operation of the UODM 66 fun and enjoyable.

Although the various embodiments described herein, describe the gears 30 as including a worm gear 30A and a worm drive gear 30B, it is envisioned that the gears 30 can include any other type of gear set that will impart rotation force on the stationary pedestal shaft 34 to cause the gear box 22, seat 14 and user to rotate about the X axis as a result of the user operating the UODM 66, and remain within the scope of the present disclosure. For example, in various embodiments, the gears 30 can include two or more cooperative bevel gears that impart rotation force to cause the gear box 22, seat 14 and user to rotate about the X axis as a result of the user operating the UODM 66.

Figure 2:
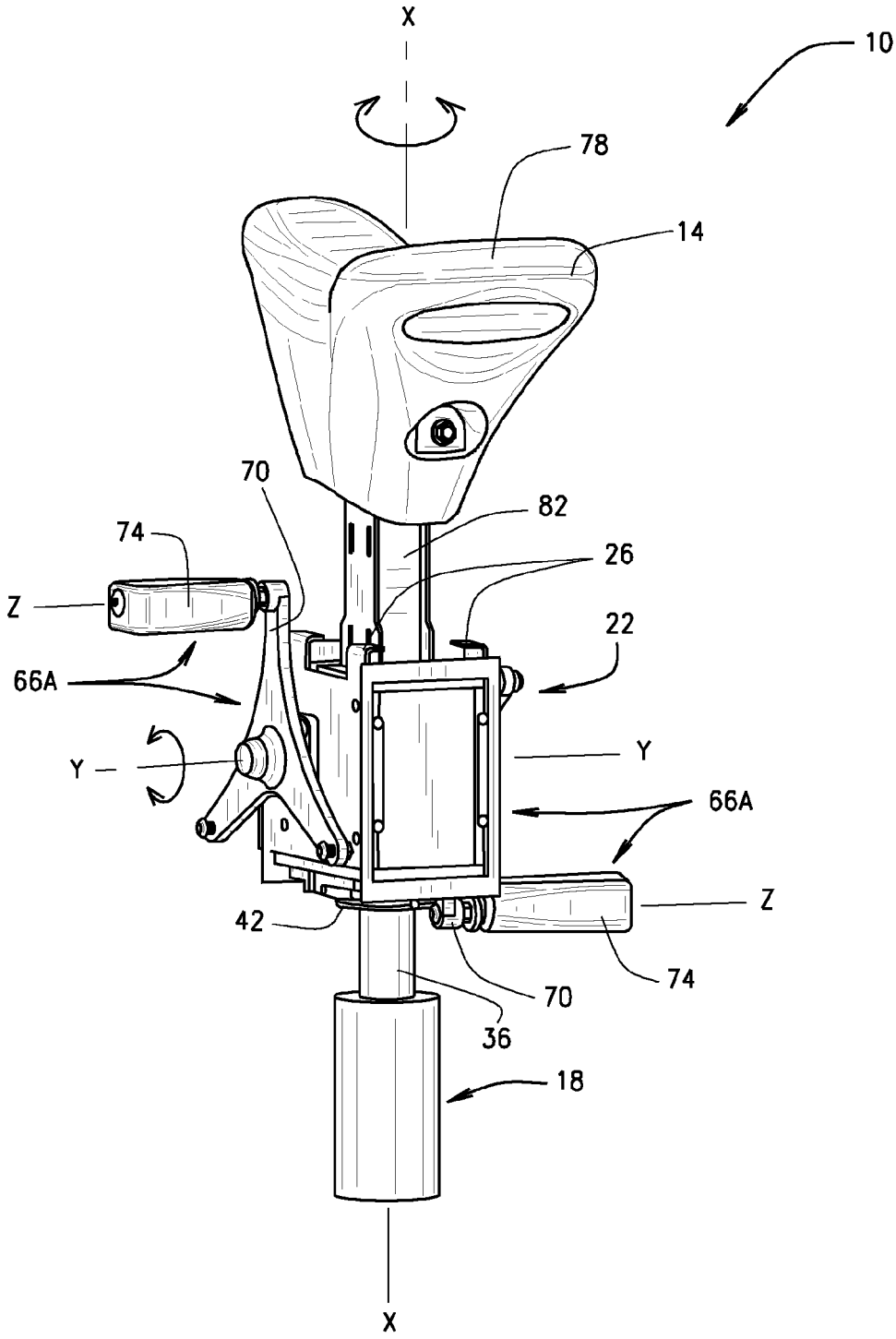
FIG. 2 is an isometric view of the rotating exercise device shown in FIG. 1, including a user operable drive mechanism that comprises a pair of opposing pedal and crank assemblies, in accordance with various embodiments of the present disclosure.
Figure 3:
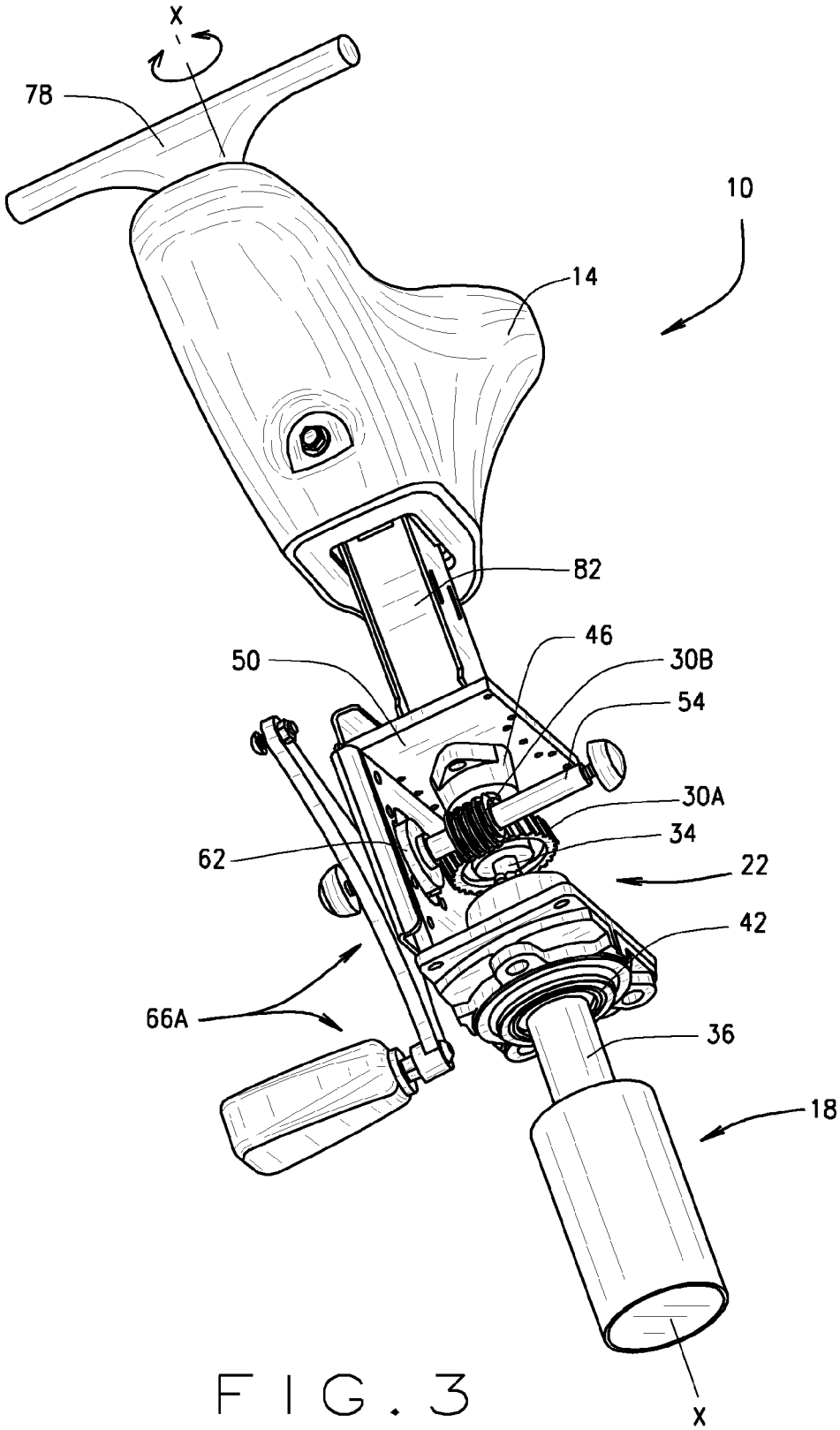
FIG. 3 is a partial bottom isometric view of the rotating exercise device shown in FIG. 2 illustrating various components of a gear box and the user operable drive mechanism thereof, in accordance with various embodiments of the present disclosure.
Figure 4:
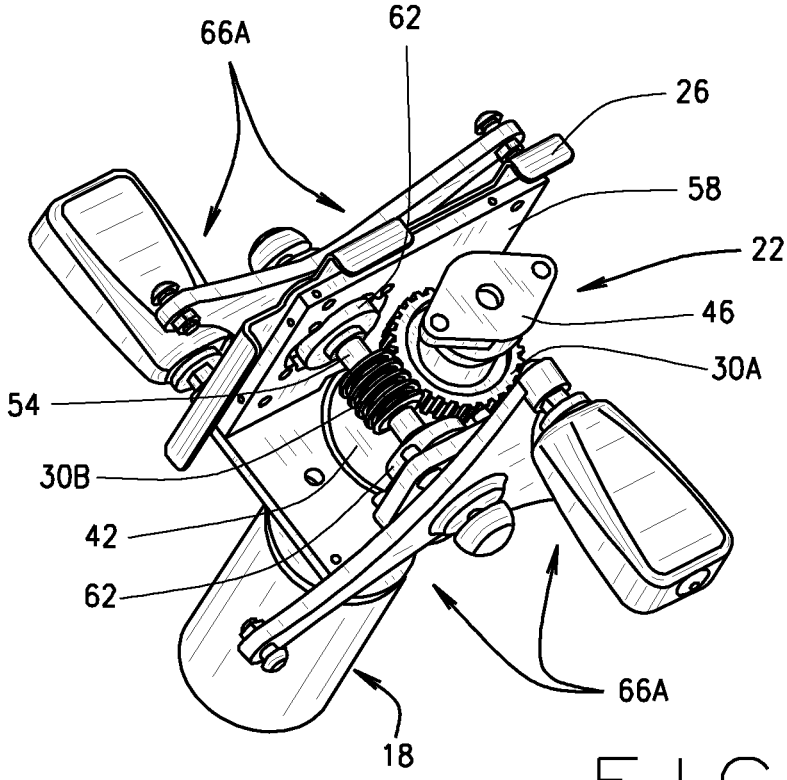
FIG. 4 is a partial top isometric view of the rotating exercise device shown in FIG. 2 illustrating the various gear box and user operable drive mechanism components, in accordance with various embodiments of the present disclosure.

Referring now to FIGS. 2, 3 and 4, in various embodiments, the UODM 66 can comprise a pair of opposing foot pedal and crank assemblies 66A. More particularly, each foot pedal and crank assembly 66A includes a crank arm 70 and a foot pedal 74. A proximal end of each crank arm 70 is fixedly mounted to a respective one of the opposing ends of the drive shaft 54 that extend outside of the gear box housing 26. Particularly, the opposing crank arms 70 extend radially in opposite directions from the respective opposing drive shaft ends. Each foot pedal 74 is mounted to a distal end of a respective one of the crank arms 70 to extend orthogonally away from the gear box 22 and is structured and operable to be rotatable about a respective center axis Z. Accordingly, as shown in FIGS. 2, 3 and 4, the foot pedal and crank assemblies 66A, in combination with the seat 14, provide bicycle-like arrangement, whereby the user can sit on the seat 14 and turn the foot pedal and crank assemblies 66A with his/her feet in a bike pedaling manner.

In various embodiments, the seat 14 includes at least one handle 78 for the user to hold while sitting on the seat 14. The at least one seat handle can be any device, structure or apparatus structured and located such that the user can easily, conveniently, and comfortably hold the handle(s) to steady himself/herself on the seat 14 and safely operate the rotating exercise device 10. For example, as exemplarily illustrated in FIG. 3, in various implementations the seat handle(s) 78 can be a set of bicycle-like handlebars, as exemplarily shown in FIG. 3 that are appropriately attached to the rotating exercise device 10, e.g., attached to the seat 14, the gear box 22 or a seat post 82, to rotate about the X axis along with the seat 14 and gear box 22, as described herein. Or, as exemplarily illustrated in FIG. 2, the seat handle(s) 78 can comprise a handle 78 formed in a portion of a saddle-like seat 14 such that the user can sit in the seat 14 with the handle 78 located in front of the user where the user can easily grasp the handle 78 as he/she operates, i.e., pedals or turns, the foot pedal and crank assemblies 66A with his/her feet. Or, alternatively, in various embodiments, the seat handle(s) 78 can be a set of side rails that are appropriately attached to the rotating exercise device 10, e.g., attached to the seat 14, the gear box 22 or a seat post 82, to rotate about the X axis along with the seat 14 and gear box 22.

Additionally, in various embodiments, the seat 14 can be mounted to the seat post 82 that is mounted to the gear box top plate 50 such that the seat 14 is positioned a particular distance above the gear box 22 and the foot pedal and crank assemblies 66A. Moreover, in various implementations, the seat post 82 can be structured and operable to be height adjustable such that the distance of the seat 14 above the gear box 22 can be adjusted to accommodate various users of different heights.

Referring now to FIGS. 3 and 4, as a user operates, i.e., pedals or turns, the foot pedal and crank assemblies 66A, the drive shaft 54 rotates in the direction in which the foot pedal and crank assemblies 66A are being turned. As a result, the worm drive gear 30B also turns in the direction in which the foot pedal and crank assemblies 66A are being turned. As described above, the worm drive gear 30B is cooperatively engaged with the worm gear 30A, which is fixedly mounted to the stationary pedestal shaft 34. Accordingly, rotation of the drive shaft 54 and worm drive gear 30B, resulting from the operation of the foot pedal and crank assemblies 66A by the user, will apply rotational force to the gear box 22 via the drive shaft 54 and side bearing assemblies 62. This rotational force will cause the gear box 22, the foot pedal and crank assemblies 66A and the seat 14 (and a user sitting in the seat 14) to rotate about the X axis making operation of the rotating exercise device 10, i.e., pedaling of the foot pedal and crank assemblies 66A, fun and enjoyable.

Figure 5:
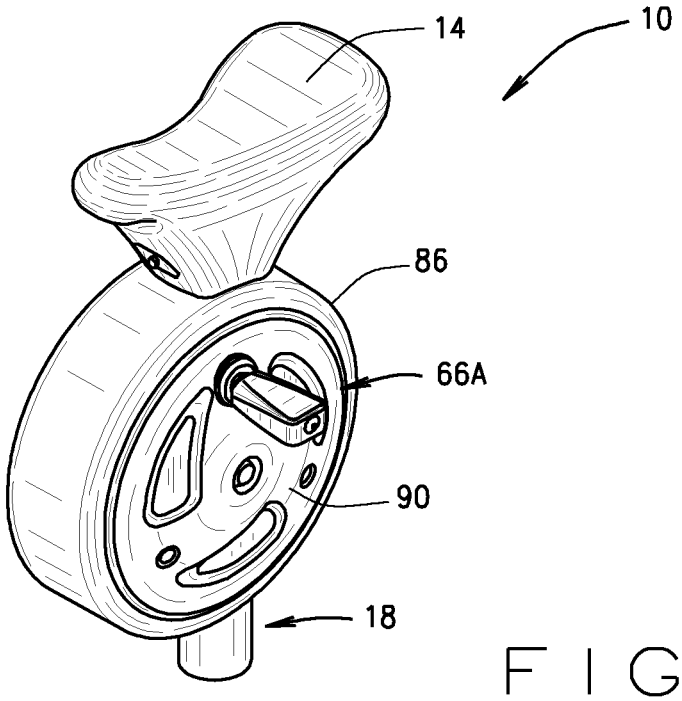
FIG. 5 is an isometric view of the rotating exercise device shown in FIG. 2 illustrating a protective cover for the gear box, in accordance with various embodiments of the present disclosure.

Referring now to FIG. 5, in various embodiments, the gear box 22 and foot pedal and crank assemblies 66A can be enclosed in a protective housing 86 and side shields 90 (only one of which is shown in FIG. 5). The protective housing 86 and side shields 90 protect the gear box 22 and the foot pedal and crank assemblies 66A from damage due to weather, environmental debris and physical abuse. The protective housing 86 and side shields 90 can also provide aesthetic character and design to the rotating exercise device 10.

Figure 6:
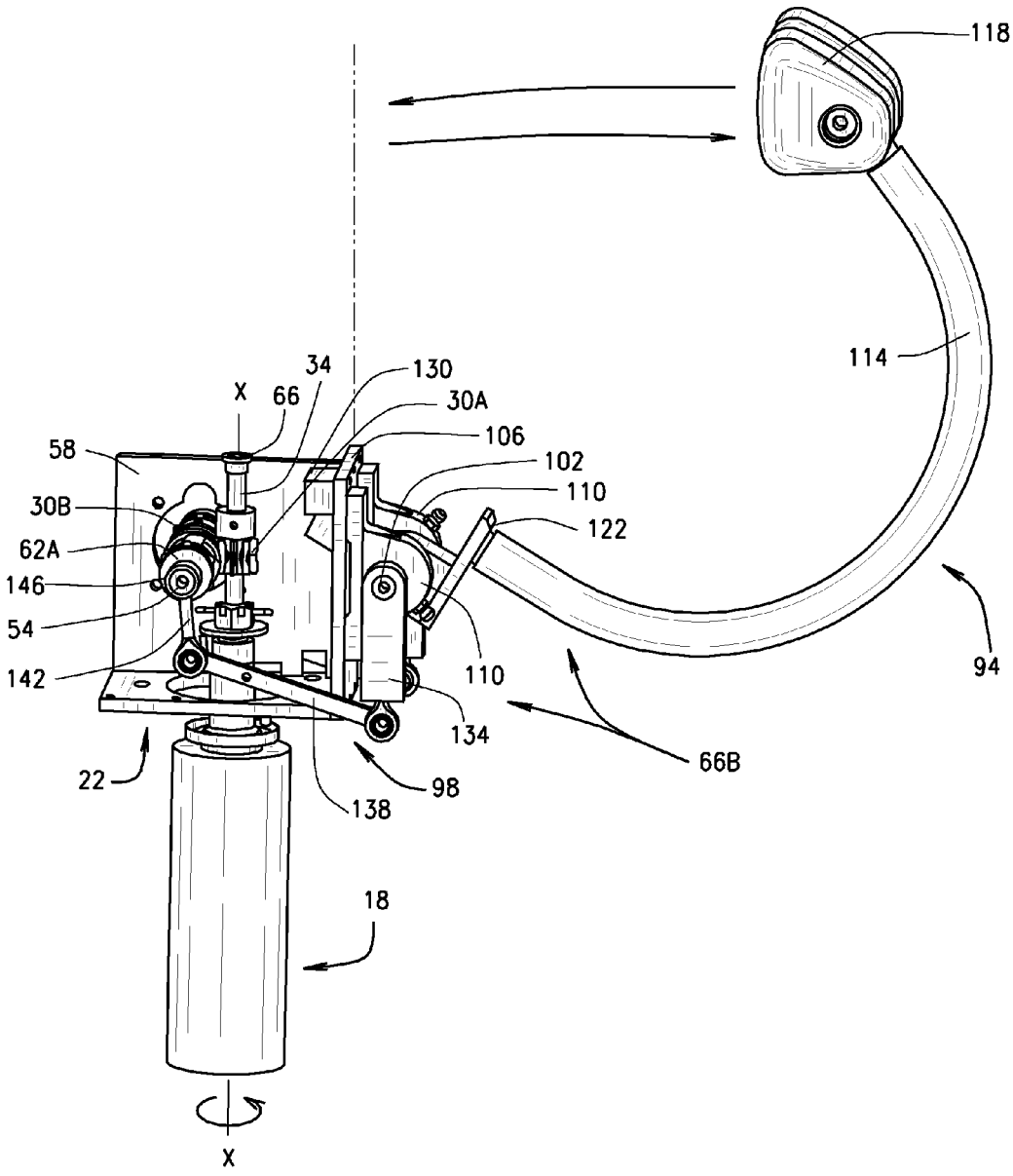
FIG. 6 is a partial isometric view of the rotating exercise device shown in FIG. 1, including a user operable drive mechanism that comprises a chest bar and crank assembly, in accordance with various embodiments of the present disclosure.
Figure 7:
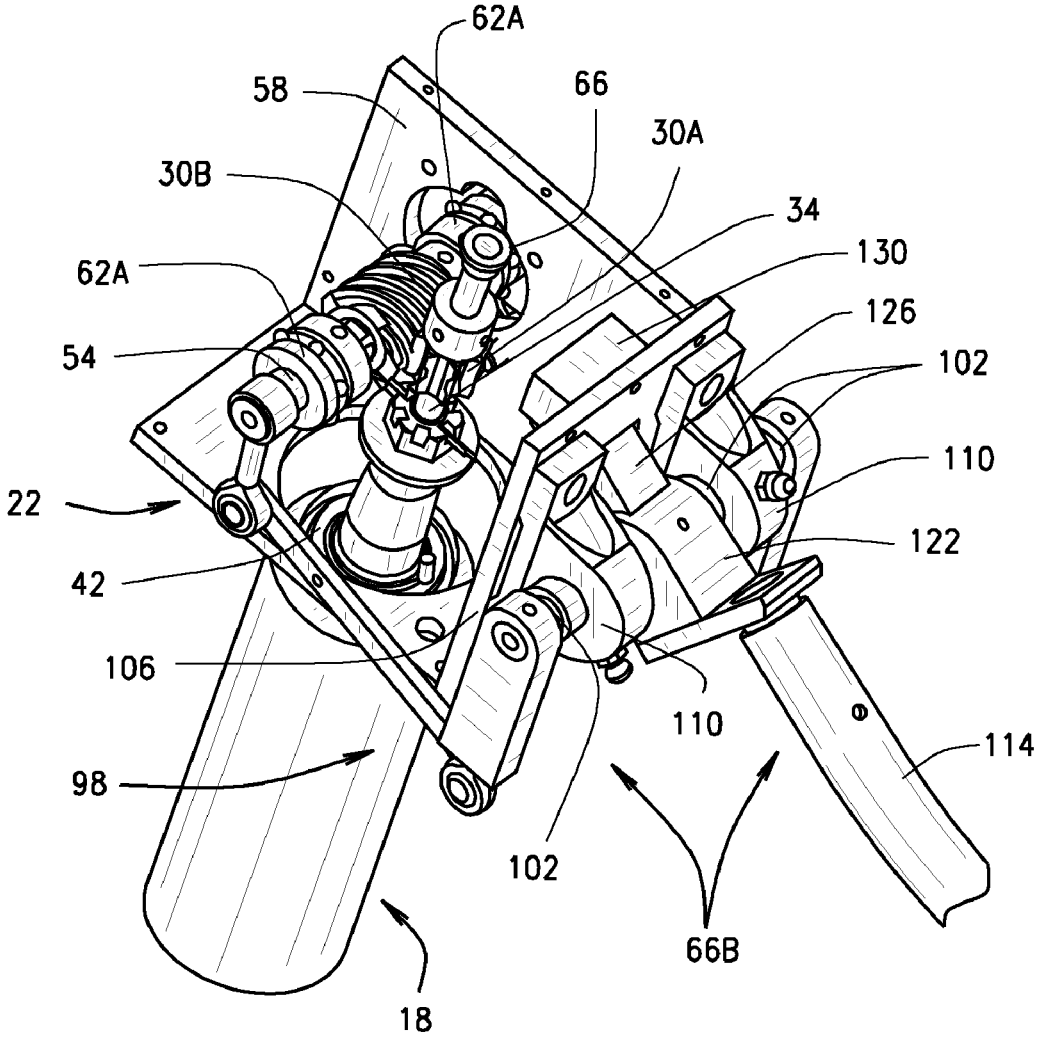
FIG. 7 is a partial top isometric view of the rotating exercise device shown in FIG. 6 illustrating various components of a gear box and the user operable drive mechanism thereof, in accordance with various embodiments of the present disclosure.
Figure 8:
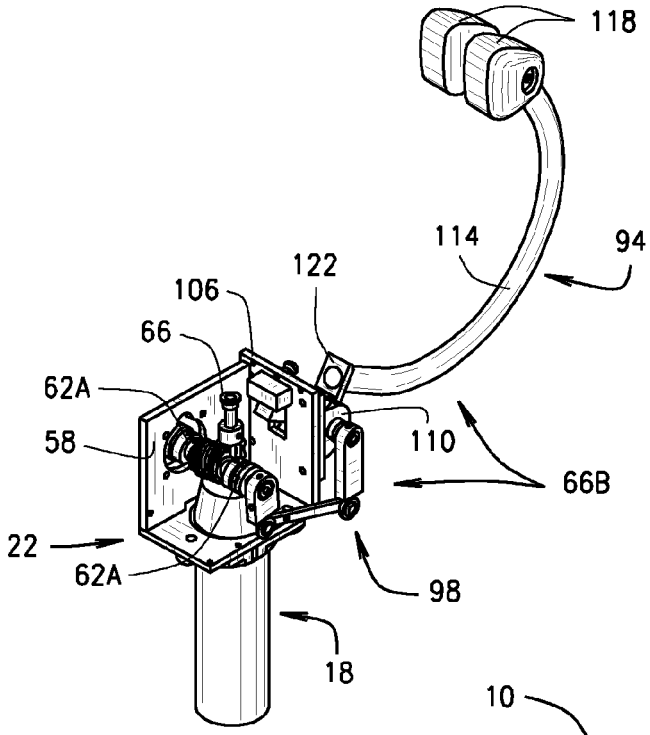
FIG. 8 is a partial isometric view of the rotating exercise device shown in FIG. 6 illustrating the various gear box and user operable drive mechanism components, in accordance with various embodiments of the present disclosure.
Figure 9:
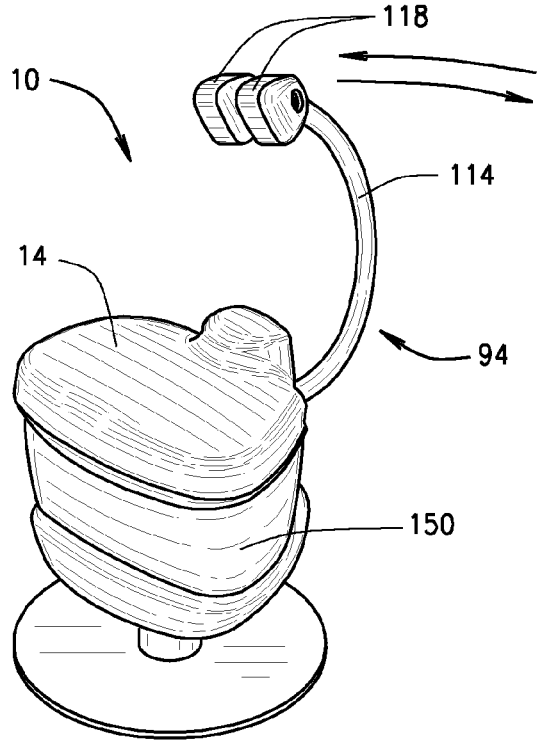
FIG. 9 is an isometric view of the rotating exercise device shown in FIG. 6 illustrating a seat and protective cover for the gear box, in accordance with various embodiments of the present disclosure.

Referring now to FIGS. 6, 7 and 8, in various embodiments, the UODM 66 can comprise a chest bar and crank assembly 66B. Generally, the chest bar and crank assembly 66B includes a chest bar subassembly 94 (FIG. 8) that is operatively coupled to a pair of drive shaft crank linkages 98 via a linking shaft 102. The linking shaft 102 is rotationally mounted within a pair of front bearing assemblies 110 that are mounted to a front plate 106 of the gear box 22. The chest bar subassembly 94 includes a lever arm 114, a head unit 118 pivotally coupled to a distal end of the lever arm 114 and a shaft mounting bracket 122 coupled to a proximal end of the lever arm 114. The mounting bracket 122 is fixedly coupled to a center portion of the linking shaft 102, between the front bearing assemblies 110, and each of the drive shaft crank linkages 98 are fixedly mounted to a respective one of opposing ends of the linking shaft 102 that extend past the respective front bearing assemblies 110. Via rotation of the linking shaft 102, the chest bar subassembly 94 is movable between a Forward position (as shown in FIG. 6) and a Home position (as shown in FIG. 9), wherein the head unit 118 is located substantially above the gear box front plate 106.

The mounting bracket 122 additionally includes a range limiting tongue 126 extending therefrom that contacts a stop 130 to limit the range of motion between the Home and Forward positions of the chest bar subassembly 94. In various embodiments, the stop 130 can be a block mounted to the gear box front plate 106.

Each drive shaft crank linkage 98 generally includes a plurality of rotationally connected link arms that connect the linking shaft 102 with the drive shaft 54 such that movement of the chest bar subassembly 94 between the Home and the Forward positions incrementally rotates the drive shaft 54 and the worm drive gear 30B mounted thereon. For example, in various embodiments, each of the side bearing assemblies 62 comprises a one-way bearing assembly 62A that is structured and operable to only allow the drive shaft 54 to rotate in one direction. Additionally, in such exemplary embodiments, each drive shaft crank linkage 98 includes a proximal link arm 134, and intermediate link arm 138 and a distal link arm 142. The proximal link arm 134 is fixedly connected at a first end to the respective end of the linking shaft 102 and rotationally connected at a second end to a first end of the intermediate link arm 138. Similarly, a second end of the intermediate link arm 138 is rotationally connected to a first end of the distal link arm 142. In various implementations, a second end of the distal link arm 142 includes a clutch mechanism 146 that fits onto, and is structured to selectively engage, the respective end of the drive shaft 54.

Accordingly, movement of the chest bar subassembly 94 between the Home and Forward positions reciprocally moves that second end of each proximal link arm 134 in an arc. The movement of the proximal linking arm second ends is transferred to the first end of the distal linking arms 142 such that movement of the chest bar subassembly 94 between the Home and the Forward positions causes the clutch mechanisms 146 to rotate about the Y axis (shown FIG. 7). More specifically, in various embodiments, as the chest bar subassembly 94 is moved from the Home position to the Forward position, each clutch mechanism 146 engages the drive shaft 54, thereby rotating the drive shaft 54 and worm drive gear 30B in a desired direction, e.g., a clockwise direction. Then, as the chest bar subassembly 94 is moved from the Forward position to the Home position, each clutch mechanism 146 substantially disengages the drive shaft 54, and the one-way bearing assemblies 62A prevents the drive shaft 54 from rotating in a direction opposite the desired direction, e.g., a counter-clockwise direction. Thus, repeated movement of the chest bar subassembly 94 between the Home and the Forward positions incrementally advances, or rotates, the drive shaft 54 and worm drive gear 30B in the desired direction, e.g., the clockwise direction.

It should be understood that although repeated movement of the chest bar subassembly 94 between the Home and the Forward positions has been exemplarily described as incrementally advancing the drive shaft 54 and worm drive gear 30B in a clockwise direction, the clutch mechanisms 146 and one-way bearing assemblies 62A could be structured and operable such that movement of the chest bar subassembly 94 incrementally advances the drive shaft 54 and worm drive gear 30B in the counter-clockwise direction. Additionally, although operation of the chest bar subassembly 94 and the crank linkage 98 has been described above such that movement of the chest bar subassembly 94 from the Home position to the Forward position causes incremental rotation of the drive shaft 54 and worm drive gear 30B, it should be understood that the chest bar subassembly 94 and the crank linkage 98 can be structured and operable so that movement of the chest bar subassembly 94 from the Forward position to the Home position causes the incremental rotation of the drive shaft 54 and worm drive gear 30B and remains within the scope of the present disclosure.

As described above, the worm drive gear 30B is cooperatively engaged with the worm gear 30A, which is fixedly mounted to the stationary pedestal shaft 34. Accordingly, the incremental rotation of the drive shaft 54 and worm drive gear 30B, resulting from the operation chest bar subassembly 94 by the user, will apply incremental rotational force to the gear box 22 via the drive shaft 54 and one-way side bearing assemblies 62A. This rotational force will cause the gear box 22, the chest bar subassembly 94 and the seat 14 to incrementally rotate (e.g., rotate in 30° increments) about the X axis making operation of the rotating exercise device 10, i.e., moving the chest bar subassembly 94 between the Home and the Forward position, fun and enjoyable.

Referring now to FIGS. 6, 7, 8 and 9, in various embodiments, the gear box 22 and crank linkages 98 can be enclosed in a protective housing 150 that protects the gear box 22 and crank case linkage 98 from damage due to weather, environmental debris and physical abuse. The protective housing 150 can also provide aesthetic character and design to the rotating exercise device 10. Additionally, in various embodiments, the seat 14 can be connected to the gear box top plate 50 (as shown in FIG. 1) and/or connected to a top portion of the protective housing 150.

Furthermore, the seat 14 is mounted such that a user sitting in an upright position in the seat 14, i.e., with his/her torso generally in an upright orientation, will face the chest bar subassembly 94 and be able to comfortably touch his/her chest to the chest bar subassembly head 118. The user can also wrap his/her arms around the chest bar subassembly head 118 to hold the head 118 firmly against his/her chest. Subsequently, using his/her abdominal muscles, the user can bend forward, while remaining seated in seat 14, to move the chest bar subassembly 94 from the Home position to the Forward position, thereby incrementally advancing the drive shaft 54, as described above. The user can then move to the upright sitting position to move the chest bar subassembly 94 back to the Home position. Thereafter, the user can repetitively move the chest bar subassembly 94 between the Home position and the Forward position, using his/her abdominal muscles, i.e., by performing abdominal crunches, to incrementally rotate the chest bar subassembly 94 and the seat 14 (and the user sitting in the seat 14) about the X axis, thereby making operation of the rotating exercise device 10, i.e., performing abdominal crunches, fun and enjoyable. The chest bar subassembly 94 can also be provided with a spring mechanism which biases the chest bar subassembly 94 to the Home position. Such a spring mechanism will provide resistance which must be overcome by the user to move the chest bar subassembly 94 to the forward position and will also aid in returning the chest bar subassembly 94 to the Home position. Such a spring could, for example, extend between the tongue 126 and an appropriate place on the housing front plate 106 or bottom.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A rotating exercise device comprising:

a stationary pedestal;

a gearbox rotatably mounted to the stationary pedestal substantially axially concentric with the longitudinal axis of the stationary pedestal such that the gearbox is rotatable about a longitudinal axis of the stationary pedestal;

a user seat connected to a top of the gearbox substantially axially concentric with the longitudinal axis of the stationary pedestal; and a user operable drive mechanism operably connected to the gearbox that is structured and operable, via control and operation of a user sitting on the seat, to impart rotational force on the stationary pedestal to cause the gearbox, seat, user operable drive mechanism and user to rotate about, and substantially axially concentrically with, the longitudinal axis of the stationary pedestal as the user operates the user operable drive mechanism.

2. The device of claim 1, wherein the gearbox comprises:

a base; and a first gear fixedly mounted to a stationary pedestal shaft having the base rotatably mounted thereto such that the gearbox and user seat are rotatably supported on the stationary pedestal.

3. The device of claim 2, wherein the gearbox further comprises:

a drive shaft rotatably mounted within the gearbox to rotate about a transverse axis that is transverse to the stationary pedestal shaft and longitudinal axis of the stationary pedestal; and a second gear fixedly mounted to the drive shaft and cooperatively engaged with the first gear, wherein the user operable drive mechanism is operable, via control and operation of the user, to impart a rotational force on the drive shaft to thereby rotate the second gear about the transverse axis, causing the first gear, gearbox and user seat to rotate about the longitudinal axis.

4. The device of claim 3, wherein the first gear is one of a worm gear and a first bevel gear, and the second gear is one of a worm drive gear and a second bevel gear.

5. The device of claim 3, wherein the user operable drive mechanism comprises a first foot pedal and crank assembly fixedly mounted to a first end of the drive shaft and a second foot pedal and crank assembly fixedly mounted to an opposing second end of the drive shaft such that the user sitting on the seat can impart rotational force on the drive shaft by turning the first and second foot pedal and crank assemblies with his/her feet.

6. The device of claim 3, wherein the user operable drive mechanism comprises a chest bar and crank assembly that includes a chest bar subassembly connected to a linking shaft rotationally mounted to a front plate of the gearbox and operatively coupled to the drive shaft via a pair of drive shaft crank linkages fixedly mounted at a first end to the linking shaft and mounted at a second end to the drive shaft such that movement of the chest bar subassembly between a Forward position and a Home position incrementally rotates the drive shaft and second gear, thereby incrementally rotating the stationary pedestal shaft, gearbox and user seat.

7. The device of claim 1, wherein the user seat comprises at least one handle structured and operable for the user to hold in order to steady himself/herself while operating the user operable drive mechanism.

8. The device of claim 1, wherein the device further comprises a height adjustable seat post mounted at a first end to the top of the gearbox and having the seat mounted to an opposing second end such that a height of the seat, relative to the top of the gearbox is adjustable.

9. The device of claim 1, wherein the device further comprises a protective housing and side shields that enclose the gearbox to protect the gearbox from damage due to at least one of foul weather, environmental debris and physical abuse.

10. A method for exercising while sitting on a rotating exercise device, said method comprising:

sitting in a user seat connected to a top of a gearbox of the rotating exercise device such that the user seat is substantially axially concentric with a longitudinal axis of a stationary pedestal of the rotating exercise device, the gearbox rotatably mounted the stationary pedestal substantially axially concentric with the longitudinal axis of the stationary pedestal such that the gearbox and seat are substantially concentrically rotatable about a longitudinal axis of the stationary pedestal;

operating a user operable drive mechanism operably connected to the gearbox to impart rotational force on the stationary pedestal that causes the gearbox, user operable drive mechanism, a user and seat to substantially concentrically rotate about the longitudinal axis of the stationary pedestal, wherein the operation of the user operable drive mechanism is designed to provide exercise focused on at least one of particular muscle groups, movements, physical coordination and cardiovascular health.

11. The method of claim 10, wherein operating the user operable drive mechanism comprises turning a first and a second foot pedal and crank assembly to impart rotational force on a drive shaft of the gearbox and thereby cause the gearbox and seat to rotate about the longitudinal axis via interoperability of a first gear fixedly mounted to a stationary pedestal shaft having a base of the gearbox rotatably mounted thereto and a second gear fixedly mounted to the drive shaft and cooperatively engaged with the first gear, wherein turning of the first and the second foot pedal and crank assembly is designed to provide exercise focused on at least one of particular muscle groups, movements, physical coordination and cardiovascular health.

12. The method of claim 10, wherein operating the user operable drive mechanism comprises moving a chest bar subassembly between a Forward position and a Home position to incrementally rotate a drive shaft of the gearbox and thereby cause the gearbox and seat to incrementally rotate about the longitudinal axis via interoperability of a first gear fixedly mounted to a stationary pedestal shaft having a base of the gearbox rotatably mounted thereto and a second gear fixedly mounted to the drive shaft and cooperatively engaged with the first gear, wherein movement of the chest bar subassembly between the Forward position and the Home position is designed to provide exercise focused on at least one of particular muscle groups, movements, physical coordination and cardiovascular health.

13. A rotating exercise device comprising:

a stationary pedestal;

a gearbox rotatably mounted to the stationary pedestal substantially axially concentric with the longitudinal axis of the stationary pedestal such that the gearbox is rotatable about a longitudinal axis of the stationary pedestal, wherein the gearbox comprises:

a base;

a first gear fixedly mounted to a stationary pedestal shaft having the base rotatably mounted thereto such that the gearbox and user seat are rotatably supported on the stationary pedestal to rotate about the longitudinal axis of the stationary pedestal;

a drive shaft rotatably mounted within the gearbox to rotate about a transverse axis that is transverse to the stationary pedestal shaft and longitudinal axis of the stationary pedestal; and a second gear fixedly mounted to the drive shaft and cooperatively engaged with the first gear;

a user seat connected to a top of the gearbox axially concentric with the longitudinal axis of the stationary pedestal; and a user operable drive mechanism operably connected to the gearbox that is structured and operable, via control and operation of a user sitting on the seat, to impart rotational force on the stationary pedestal to cause the gearbox, seat, user operable drive mechanism and user to rotate about, and substantially axially concentrically with, the longitudinal axis of the stationary pedestal as the user operates the user operable drive mechanism.

14. The device of claim 13, wherein the first gear is one of a worm gear and a first bevel gear, and the second gear is one of a worm drive gear and a second bevel gear.

15. The device of claim 13, wherein the user operable drive mechanism comprises a first foot pedal and crank assembly fixedly mounted to a first end of the drive shaft and a second foot pedal and crank assembly fixedly mounted to an opposing second end of the drive shaft such that the user sitting on the seat can impart rotational force on the drive shaft by turning the first and second foot pedal and crank assemblies with his/her feet.

16. The device of claim 13, wherein the user operable drive mechanism comprises a chest bar and crank assembly that includes a chest bar subassembly connected to a linking shaft rotationally mounted to a front plate of the gearbox and operatively coupled to the drive shaft via a pair of drive shaft crank linkages fixedly mounted at a first end to the linking shaft and mounted at a second end to the drive shaft such that movement of the chest bar subassembly between a Forward position and a Home position incrementally rotates the drive shaft and second gear, thereby incrementally rotating the stationary pedestal shaft, gearbox and user seat.

17. The device of claim 13, wherein the user seat comprises at least one handle structured and operable for the user to hold in order to steady himself/herself while operating the user operable drive mechanism.

18. The device of claim 13, wherein the device further comprises a height adjustable seat post mounted at a first end to the top of the gearbox and having the seat mounted to an opposing second end such that a height of the seat, relative to the top of the gearbox is adjustable.

19. The device of claim 13, wherein the device further comprises a protective housing and side shields that enclose the gearbox to protect the gearbox from damage due to at least one of foul weather, environmental debris and physical abuse.

* * * * *